US010815999B2

(12) United States Patent
Jeong

(10) Patent No.: US 10,815,999 B2
(45) Date of Patent: Oct. 27, 2020

(54) SCROLL COMPRESSOR HAVING A CAPACITY VARIABLE DEVICE

(71) Applicant: LG ELECTRONICS INC., Seoul (KR)

(72) Inventor: Jaeheon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 357 days.

(21) Appl. No.: 15/882,837

(22) Filed: Jan. 29, 2018

(65) Prior Publication Data

US 2018/0216618 A1 Aug. 2, 2018

(30) Foreign Application Priority Data

Feb. 1, 2017 (KR) ..... 10-2017-0014514

(51) Int. Cl.

| | |
|---|---|
| ***F04C 28/26*** | (2006.01) |
| ***F04C 18/02*** | (2006.01) |
| ***F04C 23/00*** | (2006.01) |
| ***F04C 28/24*** | (2006.01) |

(52) U.S. Cl.

CPC ..... *F04C 28/26* (2013.01); *F04C 18/0215* (2013.01); *F04C 18/0261* (2013.01); *F04C 2240/30* (2013.01)

(58) Field of Classification Search

CPC .... F04C 28/26; F04C 18/0261; F04C 23/008; F04C 28/24; F04C 18/0215

See application file for complete search history.

(56) References Cited

U.S. PATENT DOCUMENTS

| | | | | |
|---|---|---|---|---|
| 7,976,295 | B2 * | 7/2011 | Stover | F04C 28/265 417/299 |
| 8,186,970 | B2 | 5/2012 | Cho | |
| 8,568,118 | B2 * | 10/2013 | Stover | F04C 18/0215 418/55.5 |
| 2008/0138227 | A1 | 6/2008 | Knapke | |
| 2010/0254841 | A1 * | 10/2010 | Akei | F04C 18/0215 418/24 |
| 2015/0330386 | A1 | 11/2015 | Doepker | |

FOREIGN PATENT DOCUMENTS

| | | | |
|---|---|---|---|
| CN | 101165350 | A | 4/2008 |
| CN | 101424265 | A | 5/2009 |
| CN | 104061157 | A | 9/2014 |
| CN | 105090023 | A | 11/2015 |

* cited by examiner

*Primary Examiner* — Deming Wan
(74) *Attorney, Agent, or Firm* — Dentons US LLP

(57) ABSTRACT

A scroll compressor including a casing; a compression unit provided in an inner space of the casing to form a compression chamber by a pair of two scrolls; a bypass hole provided in the compression unit to bypass refrigerant suctioned into the compression chamber to the inner space of the casing; a bypass valve configured to selectively open and close the bypass hole to vary a compression capacity of the compression chamber; a back pressure chamber provided on a rear side of either one of the pair of two scrolls to support the scroll in the other scroll direction; a back pressure passage configured to communicate between the compression chamber and the back pressure chamber; and a back pressure valve configured to selectively open and close the back pressure passage.

12 Claims, 11 Drawing Sheets

SCROLL COMPRESSOR HAVING A CAPACITY VARIABLE DEVICE

CROSS-REFERENCE TO RELATED APPLICATION

The present disclosure claims the benefit of priority to Korean Application No. 10-2017-0014514, filed on Feb. 1, 2017, which is herein expressly incorporated by reference in its entirety.

BACKGROUND OF THE INVENTION

1. Field of the Invention

The present disclosure relates to a scroll compressor, and more particularly, to a scroll compressor having a capacity variable device.

2. Description of the Related Art

A scroll compressor is a compressor having a non-orbiting scroll and an orbiting scroll. The non-orbiting scroll is provided in an inner space of a casing and forms a pair of two compression chambers formed with a suction chamber, an intermediate pressure chamber, and a discharge chamber between a non-orbiting wrap of the non-orbiting scroll and an orbiting wrap of an orbiting scroll while the orbiting scroll is engaged with the non-orbiting scroll to perform an orbiting motion.

The scroll compressor is commonly used for compressing refrigerant in an air conditioner or the like because it obtains a relatively high compression ratio as compared with other types of compressors, and obtains a stable torque due to suction, compression, and discharge strokes of the refrigerant being smoothly carried out.

The scroll compressor may be classified as either a high pressure type or a low pressure type compressor depending on how refrigerant is supplied to the compression chamber. In the high pressure scroll compressor, refrigerant is suctioned directly into the suction chamber without passing through the inner space of the casing, and then discharged through the inner space of the casing. Most of the inner space of the high pressure scroll compressor forms a discharge space which is a high pressure portion. On the other hand, in the low pressure scroll compressor, refrigerant is indirectly suctioned into the suction chamber through the inner space of the casing. The inner space of the low pressure scroll compressor is divided into a suction space which is a low pressure portion and a discharge space which is a high pressure portion.

FIG. 1 is a longitudinal cross-sectional view illustrating a low pressure scroll compressor in the related art.

As illustrated in FIG. 1, the low pressure scroll compressor has a drive motor 20 for generating a rotational force in an inner space 11 of a closed casing 10, and a main frame 30, which are provided at an upper side of the drive motor 20.

On an upper surface of the main frame 30, an orbiting scroll 40 is orbitably supported by an oldham ring (not shown), and a non-orbiting scroll 50 is engaged with an upper side of the orbiting scroll 40, and provided to form a compression chamber (P). A rotation shaft 25 is coupled to a rotor 22 of the drive motor 20 and the orbiting scroll 40 is eccentrically engaged with the rotation shaft 25, and the non-orbiting scroll 50 is coupled to the main frame 30 in a rotationally constrained manner.

A back pressure chamber assembly 60 for preventing the non-orbiting scroll 50 being floated by a pressure of the compression chamber (P) during operation is coupled to an upper side of the non-orbiting scroll 50. The back pressure chamber assembly 60 is formed with a back pressure chamber 60*a* filled with refrigerant at an intermediate pressure.

A high-low pressure separation plate 15 for separating the inner space 11 of the casing 10 into a suction space 11 as a low pressure portion and a discharge space 12 as a high pressure portion while at the same time supporting a rear side of the back pressure chamber assembly 60 is provided at an upper side of the back pressure chamber assembly 60.

An outer circumferential surface of the high-low pressure separation plate 15 is coupled to an inner circumferential surface of the casing 10, and a discharge hole 15*a* communicating with a discharge port 54 of the non-orbiting scroll 50 is formed at a central portion thereof.

In FIG. 1, there is also a suction pipe 13, a discharge pipe 14, a subframe 18, a stator 21, a winding coil 21*a*, an end plate portion of an orbiting scroll 41, an orbiting wrap 42, an end plate portion of a non-orbiting scroll 50, a non-orbiting wrap 51, a suction port 53, and a modulation ring 61 for variable capacity, respectively.

According to the foregoing scroll compressor, when power is applied to the drive motor 20 to generate a rotational force, the rotation shaft 25 transmits the rotational force of the drive motor 20 to the orbiting scroll 40.

Then, the orbiting scroll 40 forms a pair of two compression chambers (P) between the orbiting scroll 50 and the non-orbiting scroll 50 while performing an orbiting motion with respect to the non-orbiting scroll 50 by the oldham ring to suction, compress, and discharge refrigerant.

At this time, a portion of the refrigerant compressed in the compression chamber (P) moves from the intermediate pressure chamber to the back pressure chamber 60*a* through a back pressure hole (not shown), and refrigerant at the an intermediate pressure flowing into the back pressure chamber 60*a* generates a back pressure to float a floating plate 65 constituting the back pressure chamber assembly 60. The floating plate 65 is brought into close contact with a lower surface of the high-low pressure separation plate 15 to allow a back pressure chamber pressure to push the non-orbiting scroll 50 to the orbiting scroll 40 while at the same time separating the suction space 11 and the discharge space 12 from each other, thereby allowing the compression chamber (P) between the non-orbiting scroll 50 and the orbiting scroll 40 to maintain airtight seal.

Here, similar to other compressors, the scroll compressor may vary a compression capacity in accordance with the demand of an apparatus (such as a freezer) to which the compressor is applied. For example, as illustrated in FIG. 1, a modulation ring 61 and a lift ring 62 are provided at an end plate portion 51 of non-orbiting scroll 50, and a control valve 63 being communicated by the back pressure chamber 60*a* and a first communication path 61*a* is provided at one side of the modulation ring 61. Furthermore, a second communication path 61*b* is formed between the modulation ring 61 and the lift ring 62, and a third communication path 61*c* being open when the modulation ring 61 floats is formed between the modulation ring 61 and the non-orbiting scroll 50. One end of the third communication path 61*c* communicates with the intermediate pressure chamber (P) and the other end thereof communicates with the suction space 11 of the casing 10.

In such a scroll compressor, during a power operation, the control valve 63 closes the first communication path 61*a* and allows the second communication path 61*b* to communicate with the suction space 11 as illustrated in FIG. 2A, thereby keeping the third communication path 61*c* in a closed state.

On the other hand, during a power saving operation, as illustrated in FIG. 2B, the control valve 63 allows the first communication path 61*a* to communicate with the second communication path 61*b*, thereby reducing compressor capacity while a portion of refrigerant in the intermediate pressure chamber (P) leaks into the suction space 11 and as the modulation ring 61 floats to open the third communication path 61*c*.

However, according to a capacity variable device of the scroll compressor in the related art concerning load of a refrigeration cycle device, as the capacity variation ratio is lowered, it may be advantageous to form a bypass hole 51*a* for capacity variation at a position illustrated in FIG. 3A rather than at a position moved toward the discharge port 54 illustrated in FIB. 3B so as to increase a variable capacity between a total load operation (hereinafter, referred to as a power operation) and a partial load operation (hereinafter, referred to as a power saving operation).

However, when the bypass hole 51*a* is moved toward the discharge port in order to lower a capacity variation ratio of the compressor, to ensure a sealing force during power saving operation, the back pressure hole 51*b* must also move toward the discharge port as the bypass hole 51*a* is moved toward the discharge port 54. This may increase frictional loss between the scrolls 40, 50 during power operation, thereby reducing overall efficiency. As a result, there has been a limit in lowering a capacity variation ratio of the scroll compressor.

Moreover, a capacity variable device of the scroll compressor in the related art has a large number of components, including the modulation ring 61, the lift ring 62 and the control valve 63. Additionally, the first communication passage 61*a*, second communication passage 61*b* and third communication passage 61*c* must be formed on the modulation ring 61 to operate the modulation ring 61, which complicates the structure of the modulation ring 61.

Furthermore, in a capacitor variable device of the scroll compressor in the related art, although the modulating ring 61 should be rapidly floated using the refrigerant of the back pressure chamber 60*a*, the modulation ring 61 is formed in an annular shape and the control valve 63 is engaged with the modulation ring 61, thereby causing a problem in rapidly floating the modulation ring as well as increasing a weight of the modulation ring 61.

SUMMARY OF THE INVENTION

The present invention has been made in order to solve at least the above problems associated with the conventional technology.

An object of the present disclosure is to provide a scroll compressor capable of lowering a capacity variation ratio so as to increase a system efficiency of a refrigeration device to which the compressor is applied.

Another object of the present disclosure is to provide a scroll compressor capable of suppressing an increase in friction loss during power operation while reducing a capacity variable ratio of the compressor and preventing the leakage of refrigerant during power saving operation to increase compressor efficiency.

Another object of the present disclosure is to provide a scroll compressor having a capacity variable device with a simplified structure so as to reduce manufacturing cost.

Another object of the present disclosure is to provide a scroll compressor having a capacity variable device with a reduced weight so as to rapidly perform capacity variation with a minimal or reduced force applied thereto.

In order to accomplish one or more of the objectives of the present disclosure, there is provided a scroll compressor in which a pair of two compression chambers are formed by a pair of two scrolls, and a back pressure chamber is formed on a rear surface of either one of the scrolls communicated with the compression chambers, wherein a plurality of back pressure holes communicating with the back pressure chamber are provided, and the plurality of back pressure holes are formed at regular intervals, and the plurality of back pressure holes are independently opened and closed to control a pressure of the back pressure chamber.

In such embodiment, the scroll compressor may be configured in such a manner that when a suction pressure is supplied to one of the plurality of back pressure holes, the other one is supplied with a discharge pressure.

In addition, in order to accomplish one or more of the objectives of the present disclosure, there is provided a scroll compressor, including a casing; a compression unit provided in an inner space of the casing to form a compression chamber by a pair of two scrolls; a bypass hole provided in the compression unit to bypass refrigerant suctioned into the compression chamber to the inner space of the casing; a bypass valve configured to selectively open and close the bypass hole to vary a compression capacity of the compression chamber; a back pressure chamber provided on a rear side of either one of the pair of two scrolls to support the scroll in the other scroll direction; a back pressure passage configured to communicate between the compression chamber and the back pressure chamber; and a back pressure valve configured to selectively open and close the back pressure passage.

In such embodiment, a plurality of back pressure passages may be formed, and the plurality of back pressure passages may be respectively communicated with the compression chambers having different pressures, and the plurality of back pressure passages may be opened and closed in opposite directions to each other according to an operation mode of the compressor.

One side surface of the plurality of back pressure valves in contact with the compression chamber may be respectively supported by an intermediate pressure between a suction pressure and a discharge pressure, and the other side surface thereof opposite to the compression chamber may be respectively supported by the suction pressure or discharge pressure.

A plurality of bypass holes may be provided, and the plurality of bypass holes may be formed to independently communicate with the respective compression chambers.

In this embodiment, a space on one side surface side in one of the plurality of back pressure valves may be communicated with a space on one side surface side of the bypass valve.

A back pressure passage communicating with a compression chamber having a relatively high pressure among the plurality of back pressure passages may be communicated with the back pressure chamber during a power saving operation, and a back pressure passage communicating with a compression chamber having a relatively low pressure may be communicated with the back pressure chamber during power operation.

In this embodiment, the scroll compressor may further include a control valve configured to control the opening and closing operations of the bypass valve and the back pressure valve while being operated in accordance with an electric signal at an inside or outside of the casing.

In addition, in order to accomplish one or more of the objectives of the present disclosure, there is provided a scroll compressor, including a casing; a drive motor provided in an inner space of the casing; a first scroll disposed in an inner space of the casing and coupled to a rotation shaft that transmits a rotational force of the drive motor to perform an orbiting motion; a second scroll engaged with the first scroll to form a compression chamber composed of a suction chamber, an intermediate pressure chamber, and a discharge chamber; a back pressure chamber assembly provided on a rear surface of the second scroll to form a back pressure chamber so as to pressurize the second scroll in the first scroll direction; a bypass hole provided between the compression chamber and an internal space of the casing to bypass refrigerant suctioned into the compression chamber to the internal space of the casing so as to vary a compression capacity of the compression chamber; a back pressure hole provided between the compression chamber and the back pressure chamber to guide part of refrigerant compressed in the compression chamber to the back pressure chamber; a first valve provided in the second scroll or the back pressure chamber assembly to selectively open and close the bypass hole according to an operation mode of the compressor; a second valve provided in the second scroll or the back pressure chamber assembly to selectively open and close the back pressure hole according to an operation mode of the compressor; and a third valve provided at an inside or outside of the casing to operate the first valve and the second valve.

In this embodiment, the back pressure hole may be communicated with a compression chamber having a pressure higher than a compression chamber communicating with the bypass hole.

In this embodiment, a plurality of the back pressure holes may be formed, and the plurality of back pressure holes may be communicated with compression chambers having different pressures.

In this embodiment, the back pressure hole may include a first back pressure hole and a second back pressure hole, and the second back pressure hole may be formed to communicate with a compression chamber having a higher pressure than the first back pressure hole.

The first back pressure hole may communicate with the back pressure chamber when the operation mode of the compressor is a power operation, and the second back pressure hole may communicate with the back pressure chamber when the operation mode of the compressor is a power saving operation.

The second back pressure hole may communicate with a rear side space of the first valve during the power operation, and the first back pressure hole may communicate with a rear side space of the first valve during the power saving operation.

In this embodiment, an internal space of the casing may be divided into a high pressure portion and a low pressure portion, and a low pressure portion of the casing may be communicated with the first back pressure hole and a rear side space of the first valve while a high pressure portion of the casing is communicated with the second back pressure hole and the back pressure chamber when the operation mode of the compressor is a power operation, and a low pressure portion of the casing may be communicated with the second back pressure hole and the back pressure chamber while a high pressure portion of the casing is communicated with the first back pressure hole and a rear side space of the second valve when the operation mode of the compressor is a power saving operation.

A plurality of the bypass holes may be provided, and the plurality of bypass holes may be opened and closed by a plurality of bypass valves independently provided, and the plurality of bypass valves may be independently accommodated in respective valve spaces, and each of the valve spaces may be respectively communicated with one connection passage, and the connection passage may be connected to one of the plurality of back pressure holes through the relevant back pressure valve, and the other one of the plurality of back pressure holes may be alternately connected to a portion communicating with the suction chamber or a portion communicating with the discharge chamber by interposing the relevant back pressure valve therebetween in accordance with an operation mode of the compressor.

According to a scroll compressor of the present disclosure, a plurality of back pressure holes communicating with a back pressure chamber may be formed at predetermined intervals and independently opened and closed to control a pressure of the back pressure chamber according to a capacity variation of the compressor so that efficiency is not reduced due to capacity variation as well as significantly reducing a capacity variation ratio of the compressor.

According to a scroll compressor of the present disclosure, a back pressure may be differently controlled according to the operation mode of the compressor to prevent refrigerant leakage during a power saving operation while at the same time reducing a friction loss during power operation, thereby increasing compressor efficiency and improving the efficiency of a system to which the compressor is applied.

According to a scroll compressor of the present disclosure, an unnecessary input load may be reduced while lowering the capacity variable ratio through a plurality of bypass holes, thereby increasing compressor efficiency and improving the efficiency of a system to which the compressor is applied.

Moreover, according to a scroll compressor of the present disclosure, a valve for opening and closing a bypass passage of refrigerant may be configured with a bypass valve operated by a small pressure change, thereby quickly and precisely switching the operation mode of the compressor.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Hereinafter, a scroll compressor according to the present disclosure will be described in detail with reference to various embodiments illustrated in the accompanying drawings.

These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
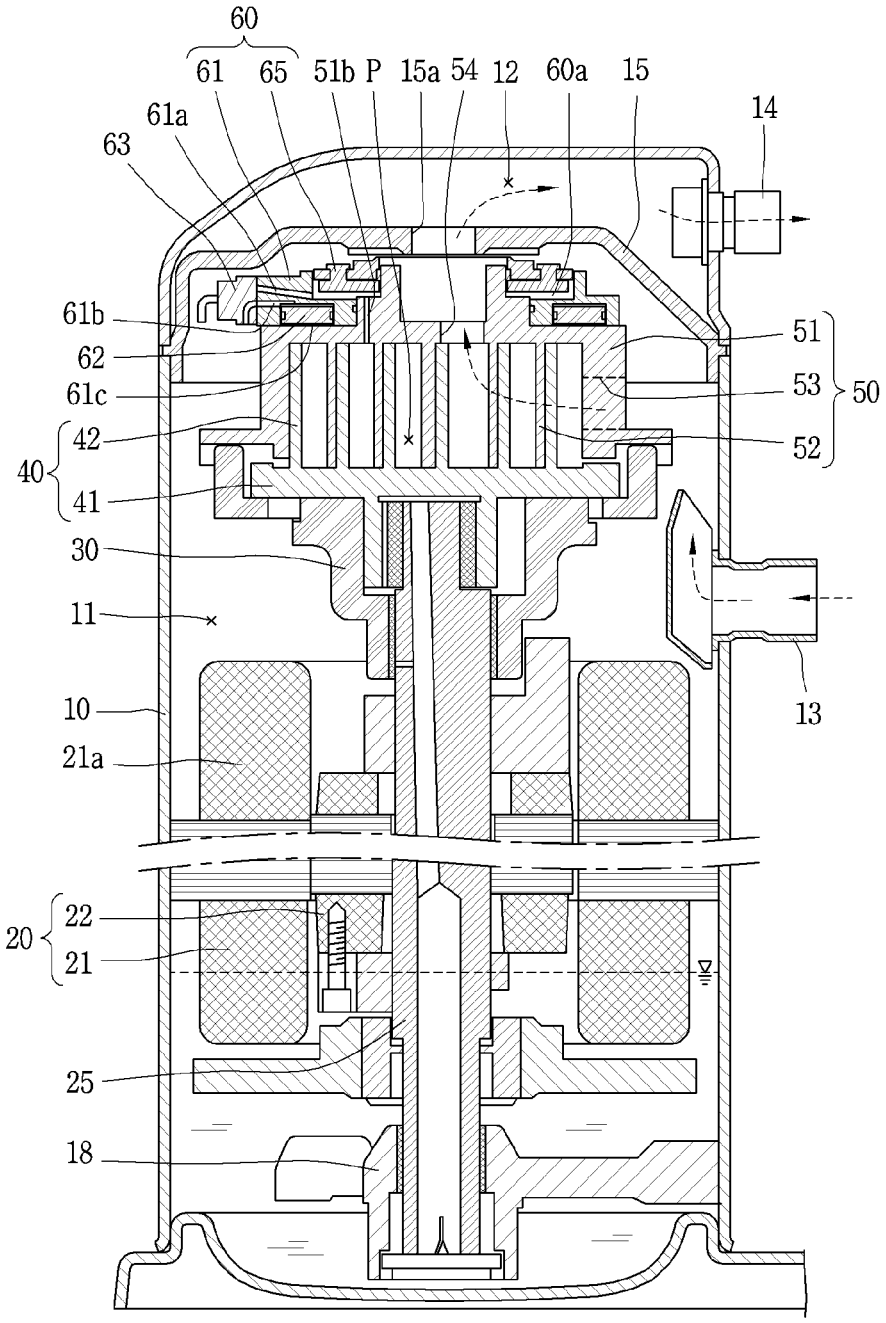
FIG. 1 RELATED ART
FIG. 1 is a longitudinal cross-sectional view illustrating a scroll compressor having a capacity variable device in the related art.
Figure 2A:
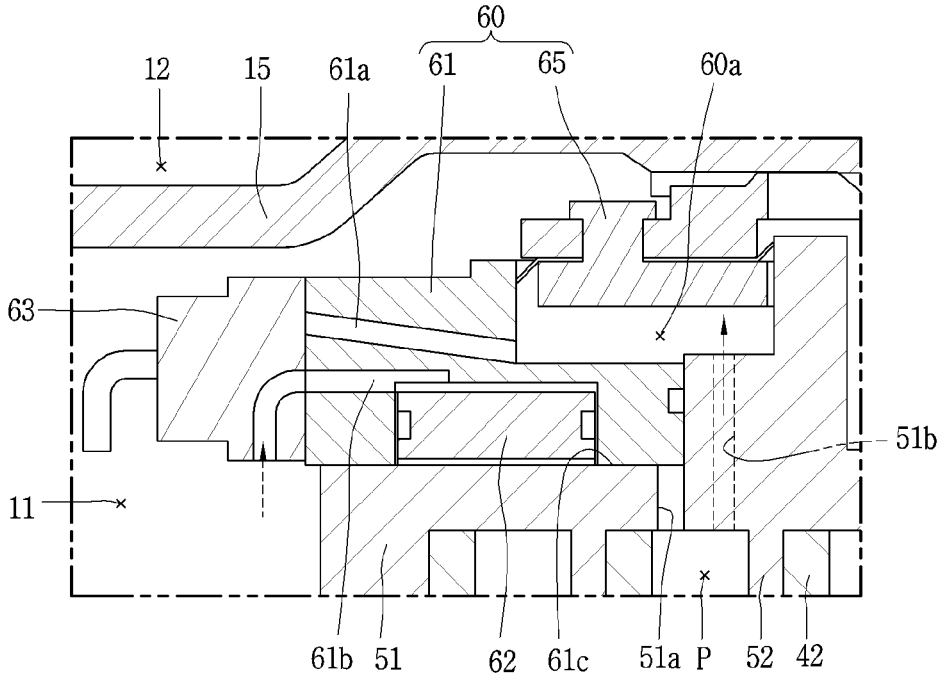
FIG. 2A RELATED ART
FIG. 2A is a longitudinal cross-sectional view illustrating a power operation state using a capacity variable device in the scroll compressor according to FIG. 1.
Figure 2B:
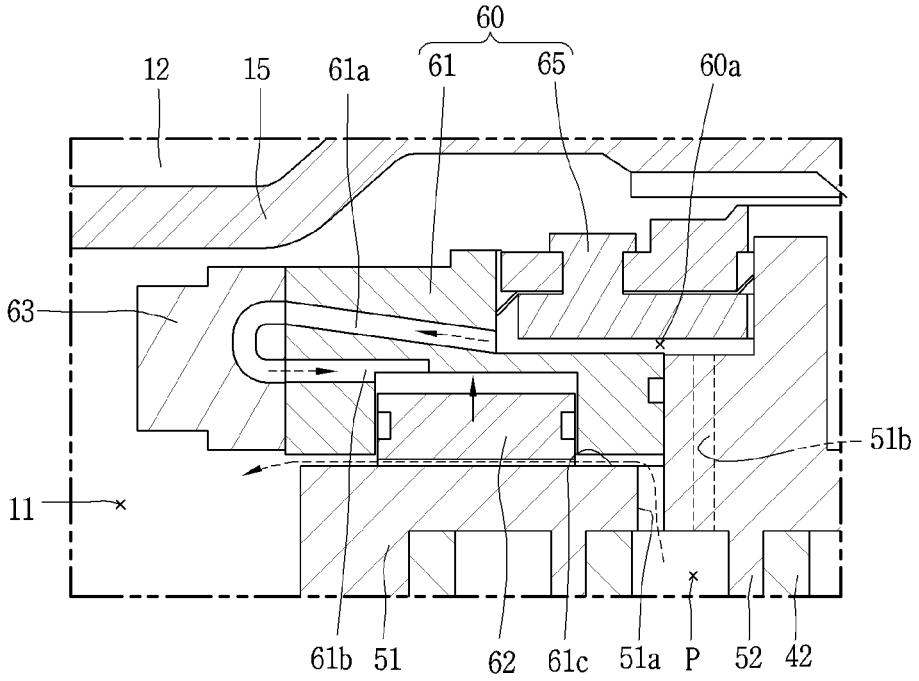
FIG. 2B RELATED ART
FIG. 2B is a longitudinal cross-sectional view illustrating a power saving operation state using a capacity variable device in the scroll compressor according to FIG. 1.
Figure 3A:
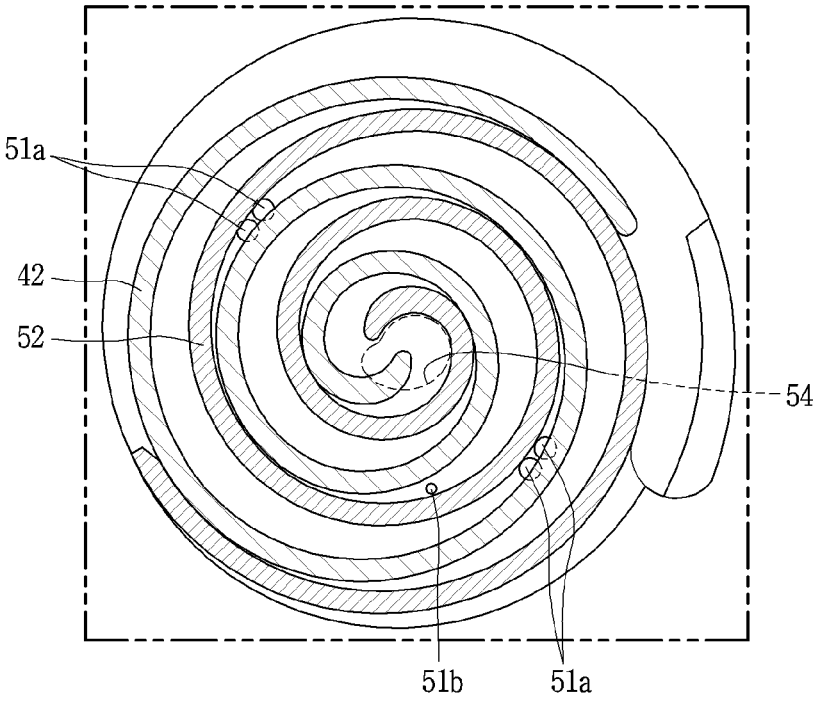
FIG. 3A RELATED ART
FIG. 3A is a plan view illustrating a positional change on a back pressure hole according to the position of a bypass hole in a scroll compressor in the related art.
Figure 3B:
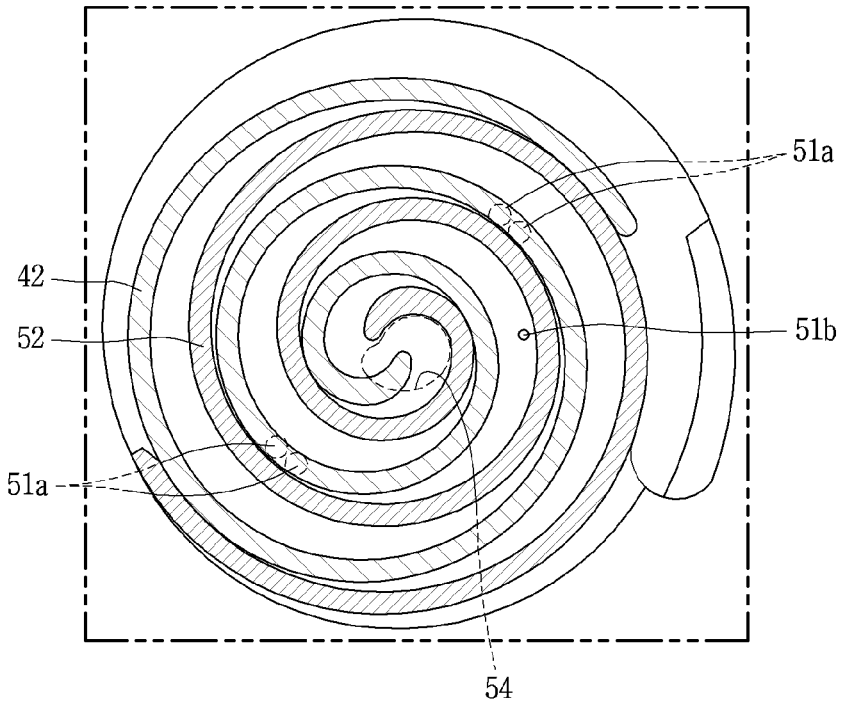
FIG. 3B RELATED ART
FIG. 3B is a plan view illustrating a positional change on a back pressure hole according to the position of a bypass hole in a scroll compressor in the related art.
Figure 4:
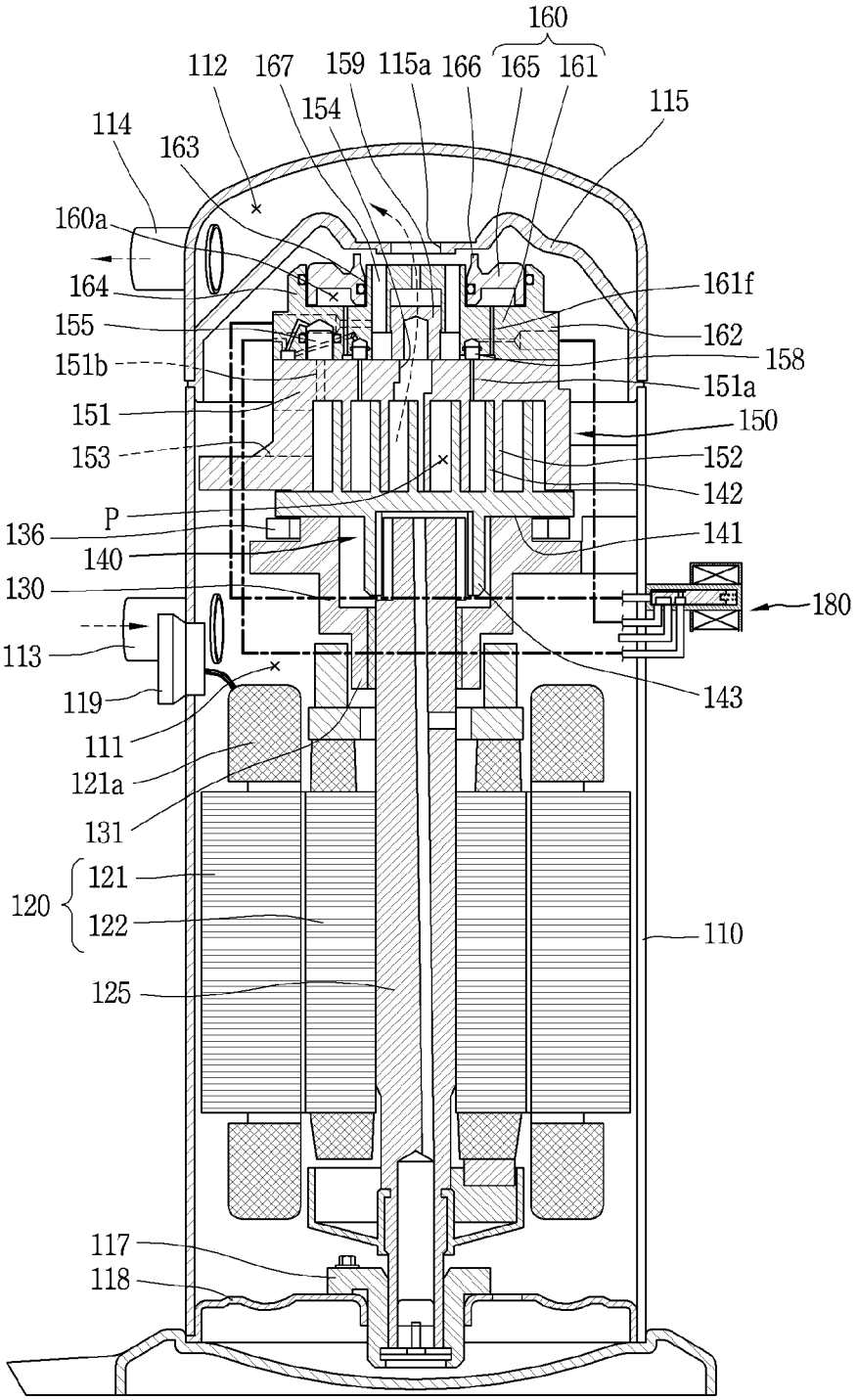
FIG. 4 is a longitudinal cross-sectional view illustrating a scroll compressor having a capacity variable device according to an embodiment of the present disclosure.
Figure 5:
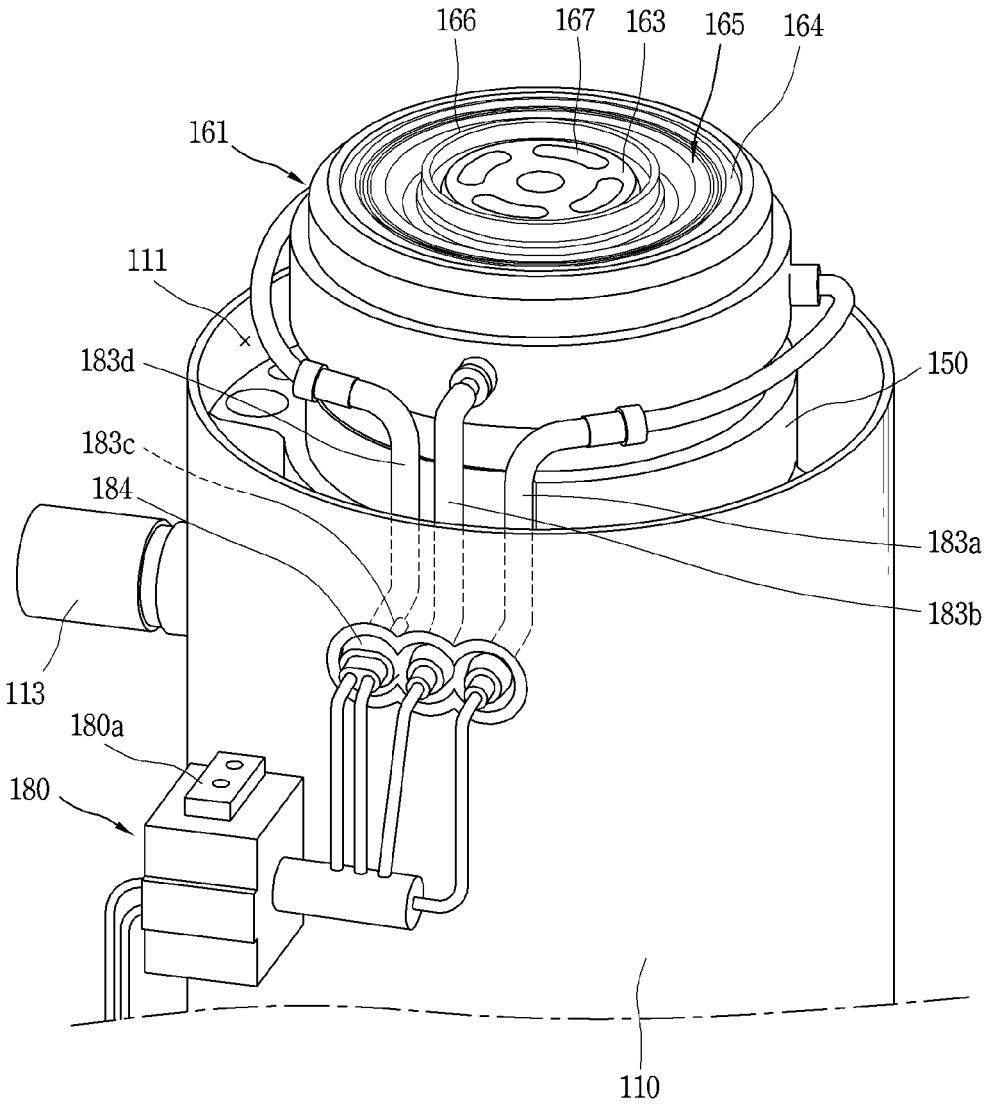
FIG. 5 is a perspective view illustrating a scroll compressor having the capacity variable device according to FIG. 4.
Figure 6:
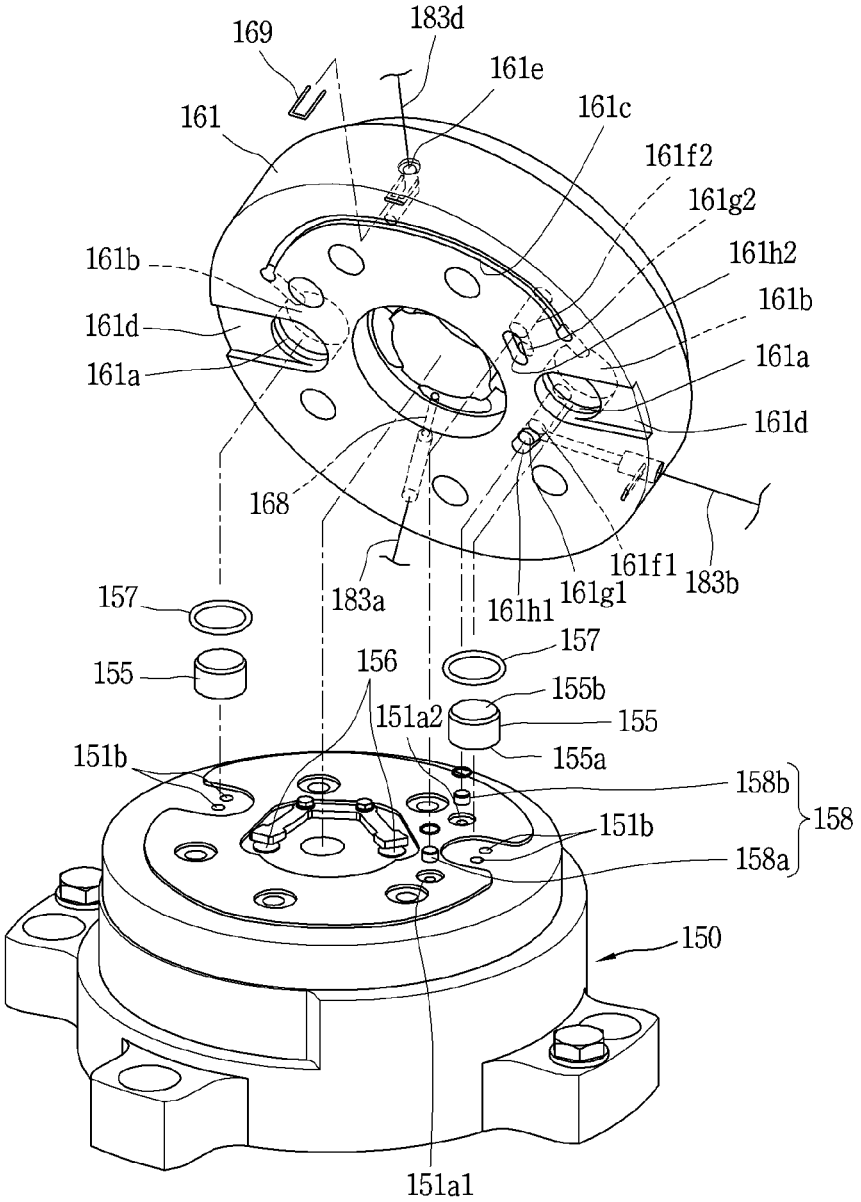
FIG. 6 is an exploded perspective view illustrating the capacity variable device in FIG. 4.
Figure 7:
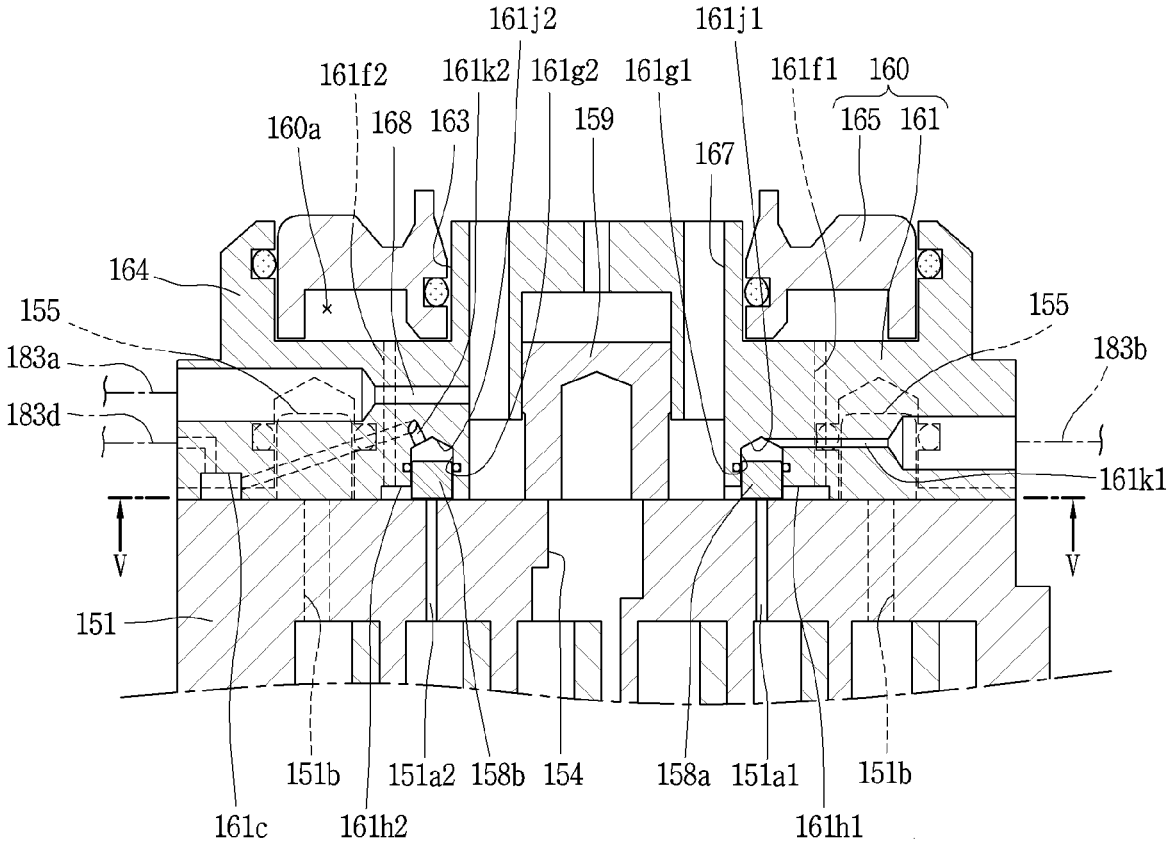
FIG. 7 is an enlarged longitudinal cross-sectional view illustrating a compression unit in FIG. 4.
Figure 8:
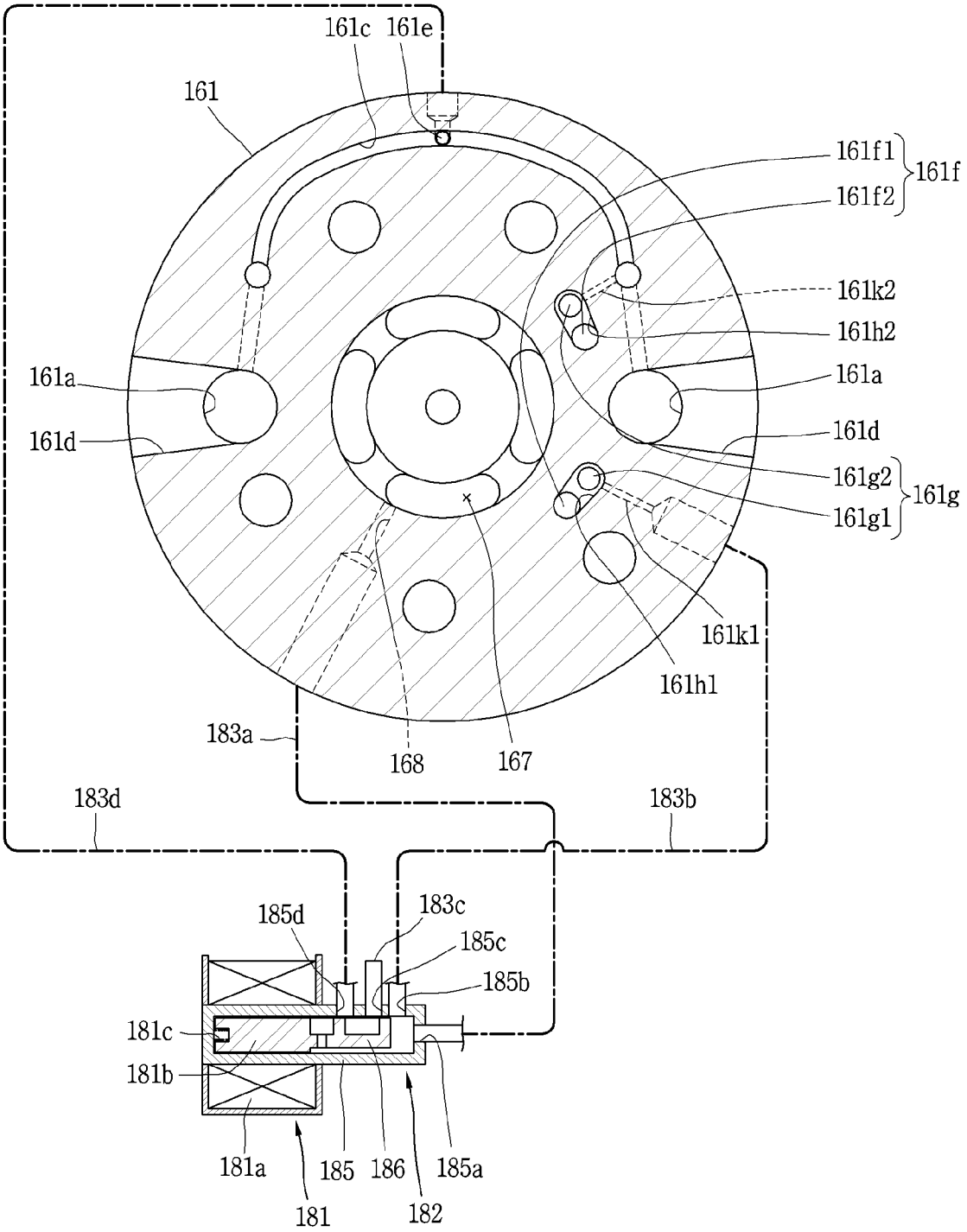
FIG. 8 is a cross-sectional view taken along line "V-V" in FIG. 7.
Figure 9:
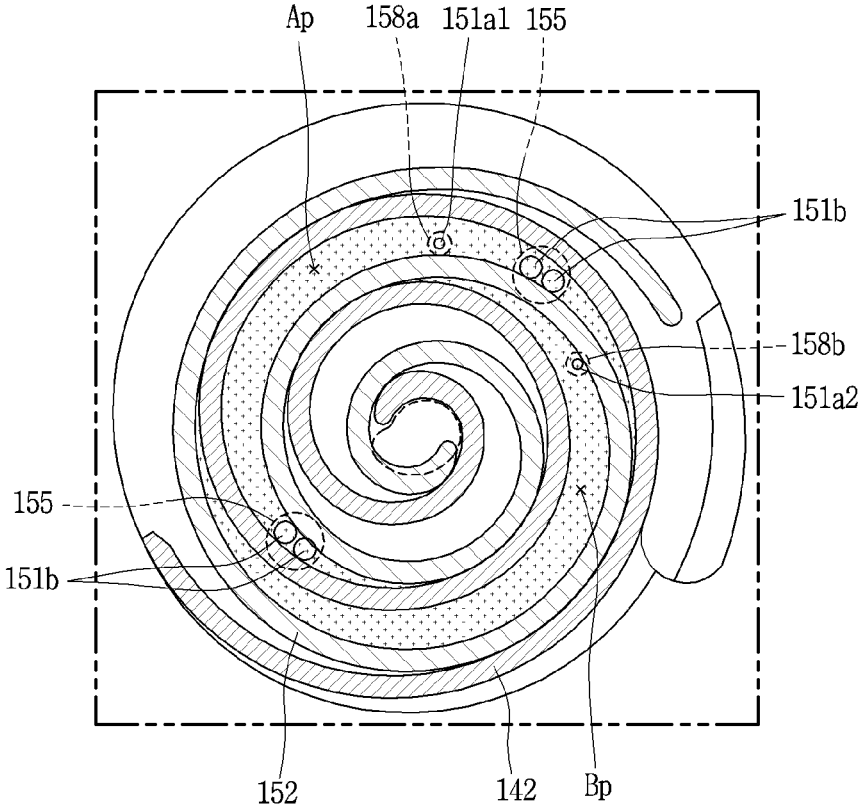
FIG. 9 is a plan view for explaining the positions of a bypass hole and a back pressure hole in FIG. 7.

FIG. 4 is a longitudinal cross-sectional view illustrating a scroll compressor having a capacity variable device according to an embodiment of the present disclosure. FIG. 5 is a perspective view illustrating a scroll compressor having the capacity variable device according to FIG. 4. FIG. 6 is an exploded perspective view illustrating the capacity variable device in FIG. 4. FIG. 7 is an enlarged longitudinal cross-sectional view illustrating a compression unit in FIG. 4. FIG. 8 is a cross-sectional view taken along line "V-V" in FIG. 7. FIG. 9 is a plan view for explaining the positions of a bypass hole and a back pressure hole in FIG. 7.

As illustrated in FIG. 4, a closed inner space of the casing 110 may be divided into a suction space 111, which is a low pressure portion, and a discharge space 112, which is a high pressure portion, by a high-low pressure separation plate 115 provided at an upper side of a non-orbiting scroll (hereinafter, used interchangeably with a "second scroll") which will be described later. As shown, the suction space 111 may correspond to a lower space of the high-low pressure separation plate 115, and the discharge space 112 may correspond to an upper space of the high-low pressure separation plate.

A suction pipe 113 communicating with the suction space 111 and a discharge pipe 114 communicating with the discharge space 112 may be respectively attached to the casing 110 to suction refrigerant into the inner space of the casing 110 or discharge refrigerant out of the casing 110.

A drive motor 120 having a stator 121 and a rotor 122 may be disposed in the suction space 111 of the casing 110. The stator 121 may be attached to an inner wall surface of the casing 110 in a heat shrinking manner, and a rotation shaft 125 may be inserted and coupled to a central portion of the rotor 122. A coil 121*a* may be wound around the stator 121, and the coil 121*a* may be electrically connected to an external power source through a terminal 119 which is penetrated and coupled to the casing 110, such as illustrated in FIGS. 4 and 5.

A lower side of the rotation shaft 125 may be rotatably supported by an auxiliary bearing 117 provided below the casing 110. The auxiliary bearing 117 may be supported by a lower frame 118 fixed to an inner surface of the casing 110 to stably support the rotation shaft 125. The lower frame 118 may be welded and fixed to an inner wall surface of the casing 110, and a bottom surface of the casing 110 may be used to form an oil storage space. Oil stored in the oil storage space may be transferred to the upper side by the rotation shaft 125 or the like, and the oil enters the drive unit and the compression chamber to facilitate lubrication.

An upper end portion of the rotation shaft 125 may be rotatably supported by the main frame 130.

The main frame 130 may be provided (e.g., fixed and installed) on an inner wall surface of the casing 110, such as the lower frame 118, and a downwardly protruding main bearing portion 131 may be formed on a lower surface thereof. The rotation shaft 125 may be inserted into the main bearing portion 131. An inner wall surface of the main bearing portion 131 may function as a bearing surface, and supports the rotation shaft 125.

An orbiting scroll (hereinafter, used interchangeably with a "first scroll") 140 may be disposed on an upper surface of the main frame 130.

The first scroll 140 may include a first end plate portion 141 having a substantially disk shape and an orbiting wrap (hereinafter, referred to as a "first wrap") 142 that is spirally formed at one side surface of the first end plate portion 141. The first wrap 142 may form a compression chamber (P) together with a second wrap 152 of a second scroll 150, which is described below.

The first end plate portion 141 is orbitably driven while being supported by an upper surface of the main frame 130. An oldham ring 136 may be provided between the first end plate portion 141 and the main frame 130 so as to prevent the rotation of the first scroll 140.

A boss portion 143 into which the rotation shaft 125 is inserted may be formed at a bottom surface of the first end plate scroll 141. With such configuration, the first scroll 140 may be orbitably driven by a rotational force of the rotation shaft 125.

The second scroll 150 engaging with the first scroll 140 is disposed at an upper portion of the first scroll 140. The second scroll 150 is provided to be movable up in an and down direction (vertically) with respect to the first scroll 140. A plurality of guide pins (not shown) may be inserted into the main frame 130 and placed and supported at an upper surface of the main frame 130 in a state of being inserted into a plurality of guide holes (not shown) formed on an outer circumferential portion of the second scroll 150.

On the other hand, as illustrated in the embodiment shown in FIGS. 4 and 6, for the second scroll 150, the second end plate portion 151 may be formed in a disk shape, and the second wrap 152 forming a pair of two compression chambers in engagement with the first wrap 142 may be formed in a spiral shape at a lower portion of the second end plate portion 151.

A suction port 153 for suctioning refrigerant existing within the suction space 111 may be formed at a side surface of the second scroll 150, and a discharge port 154 for discharging the compressed refrigerant may be formed in a substantially central portion of the second end plate portion 151.

Here, the first wrap 142 and the second wrap 152 may form a plurality of compression chambers (P). The compression chambers (P) may be orbitably moved to a side of the discharge port 154 while reducing the volume so as to compress refrigerant. Therefore, for example, a pressure of the compression chamber (P) adjacent to the suction port 153 is minimized, a pressure of the compression chamber (P) communicating with the discharge port 154 is maximized, and a pressure of the compression chamber (P) existing there between forms an intermediate pressure having a value between a suction pressure of the suction port 153 and a discharge pressure of the discharge port 154.

Furthermore, an intermediate pressure may flow into or be applied to the back pressure chamber 160*a* (described in more detail below), and performs the role of pressing the second scroll 150 toward the first scroll 140 while forming a back pressure. Accordingly, the second end plate portion 151 may be provided with a scroll side back pressure hole 151*a* communicating with one of regions having the intermediate pressure, and the scroll side back pressure hole 151*a* may be communicated with a plate side back pressure hole 161*f* (described in more detail below).

A plurality of scroll side back pressure holes 151*a* may be formed. Each scroll side back pressure hole 151*a* may be selectively communicated with the plate side back pressure hole 161*f* by the back pressure valves 158, respectively. The back pressure holes and the back pressure valves are described in more detail below.

On the other hand, a back pressure plate 161 constituting part of the back pressure chamber assembly 160 may be attached to an upper portion of the second end plate portion 151.

The back pressure plate 161 may be formed having a substantially annular shape, and may include a support plate portion 162 that is in contact with the second end plate portion 151. For example, the support plate portion 162 may have an annular plate shape with a hollow center, and a plurality of plate side back pressure holes 161*f* independently communicating with the foregoing respective scroll side back pressure holes 151*a* formed to penetrate the support plate portion 162 in an axial direction.

First and second annular walls 163, 164 may be formed at an upper surface of the support plate portion 162 so as to surround the inner and outer circumferential surfaces of the support plate portion 162. An outer circumferential surface of the first annular wall 163, an inner circumferential surface of the second annular wall 164, and an upper surface of the support plate portion 162 together may form an annular back pressure chamber 160*a*.

A floating plate 165 constituting an upper surface of the back pressure chamber 160*a* may be provided at an upper side of the back pressure chamber 160*a*. A sealing end portion 166 may be provided at an upper end portion of an inner space portion of the floating plate 165. The sealing end portion 166 may be formed to protrude or extend in an upward direction from a surface of the floating plate 165, and its inner diameter may be formed so that it does not cover a portion of the intermediate discharge port 167. The sealing end portion 166 may be in contact with a lower surface of the high-low pressure separation plate 115 so as to seal the discharged refrigerant to be discharged into the discharge space 112 without leaking into the suction space 111.

The foregoing scroll compressor according to this exemplar embodiment may operate as follows.

The rotation shaft 125 rotates together with the rotor 122 when power is applied to the stator 121.

Then, the first scroll 140 coupled to an upper end portion of the rotation shaft 125 performs an orbiting motion with respect to the second scroll 150 so as to form a pair of two compression chambers (P. The pair of two compression chambers (P) have a reduced volume while moving directionally from the outside to the inside, respectively, to suction, compress and discharge refrigerant.

At this time, a portion of refrigerant moving along the trajectory of the compression chamber (P) moves to the back pressure chamber 160*a* through the scroll side back pressure hole 151*a* and the plate side back pressure hole 161*f* before reaching the discharge port 154. Accordingly, the back pressure chamber 160*a* formed by the back pressure plate 161 and the floating plate 165 forms an intermediate pressure.

As a result, the floating plate 165 is brought into close contact with the high-low pressure separation plate 115 while receiving a pressure in an upward direction, and the discharge space 112 and the suction space 111 of the casing 110 are then separated from each other so as to prevent refrigerant discharged to the discharge space 112 from leaking to the suction space 111. On the contrary, the back pressure plate 161 may receive a downward pressure which pressurizes the second scroll 150 in the first scroll direction. The second scroll 150 is then brought into contact or near contact with the first scroll 140 so as to prevent refrigerant compressed in the compression chamber (P) from leaking between the first scroll 140 and the second scroll 150.

Consequently, a series of processes for allowing refrigerant suctioned into the suction space 111 of the casing 110 to be compressed in the compression chamber (P) and discharged to the discharge space 112, and allowing refrigerant discharged to the discharge space 112 to be circulated in the refrigeration cycle, and then suctioned again into the suction space 111 are repeated.

The scroll compressor described above may be provided with a capacity variable device capable of performing a full load operation (hereinafter, a "power operation") or a partial load operation (a "power saving operation") according to the requirements of a system to which the compressor is applied.

For example, as illustrated in FIGS. 6 through 9, the capacity variable device may include a bypass hole for capacity variation (hereinafter, abbreviated to as a "bypass hole") formed in a penetrating manner, and a bypass valve 155 provided at one end of the bypass hole 151*b* to selectively open and close the bypass hole 151*b* to vary the operation mode.

As illustrated in FIGS. 4 and 7, the bypass hole 151*b* may penetrate through the second end plate portion 151*b* to a rear side of the second end plate portion 151*b* in the intermediate pressure chamber.

A plurality of bypass holes 151*b* may be formed. The plurality of bypass holes 151*b* may be formed at intervals of 180 degrees on an inner pocket constituting a first compression chamber (Ap) and an outer pocket constituting a second compression chamber (Bp) with respect to the first wrap 142 to bypass intermediate pressure refrigerant at the same pressure.

However, when a wrap length of the first wrap 142 is asymmetric, such as when a wrap length of the first wrap 142 is larger than that of the second wrap 152 by 180 degrees, the same pressure is formed at the same crank angle in the inner pocket and the outer pocket. Accordingly, in this case, two bypass holes 151*b* may be formed at the same crank angle or only one thereof may be formed to communicate both sides.

The bypass valve 155 may be provided at an end portion of the bypass hole 151*b* to selectively open and close the bypass hole 151*b* according to the operation mode of the compressor.

The bypass valve 155 may constitute a first valve as a check valve. The bypass valve 155 may be configured with a piston valve slidably provided in a valve space 161*a* of a valve plate 161 (described in more detail below) to open and close the bypass hole 151*b* while moving in an upward and downward direction (vertical) in the valve space 161*a* according to a pressure of the intermediate pressure chamber. It is understood that the bypass valve 155 is not limited to a piston valve but instead may be any shape as long as it is a valve that can be controlled using a differential pressure.

As illustrated in the exemplar embodiment shown in FIGS. 6 through 8, a plurality of first valve spaces 161*a* may be provided to accommodate the respective bypass valves 155. Each of the first valve spaces 161*a* may be formed on a lower surface of the back pressure plate 161, and a first differential pressure space 161*b* having a predetermined volume 161*b* may be formed on a side surface of each bypass valve 155, e.g., at a rear side of each bypass valve 155. Preferably, a transverse cross-sectional area of the first differential pressure space 161*b* is larger than that of the bypass hole 151*b*.

A plurality of first differential pressure spaces 161*b* may be formed on both sides with a phase difference of 180 degrees together with the respective valve spaces 161*a*, and the differential pressure spaces 161*b* on both sides may communicate with each other through a connection passage groove 161*c* formed on a lower surface of the back pressure plate 161.

Both ends of the connection passage groove 161*c* may be formed so as to be inclined directionally toward the respective first differential pressure spaces 161*b*. Preferably, the connection passage groove 161*c* is overlapped with a gasket (not shown) provided on an upper surface of the non-orbiting scroll 150 in order to seal the connection passage groove 161*c*.

A plurality of exhaust grooves 161*d* for communicating each bypass hole 151*b* with the suction space 111 of the casing 110 may be formed on a lower surface of the back pressure plate 161. The plurality of exhaust grooves 161*d* have a predetermined depth from the respective bypass holes 151*b* toward an outer circumferential surface of the back pressure plate 161, and the respective exhaust grooves 161*d* may be formed to independently communicate with the respective bypass holes 151*b*.

The exhaust groove 161*d* may be formed in a radial direction from an inner circumferential surface of the first valve space 161*a* toward an outer circumferential surface of the back pressure plate 161, and an outer circumferential surface of the exhaust groove 161*d* may be formed to be open to communicate with the suction space 111 of the casing 110.

Accordingly, when each bypass valve 155 is open, refrigerant in the intermediate compression chamber is exhausted to the suction space 111 of the casing 110 through each of the bypass holes 151*b* and the exhaust groove 161*d*. As a result, as both the bypass holes 151*b* communicate independently with the suction space 111 of the casing 110 through the respective exhaust grooves 161*d*, refrigerant bypassed from the compression chamber (P) through both the bypass holes 151*b* is directly discharged into the suction space 111 of the casing 110 without being merged into one place. Accordingly, refrigerant bypassed from the compression chamber may be prevented from being heated by the refrigerant of the back pressure chamber 160*a*. Additionally, when the refrigerant bypassed from the compression chamber to the suction space 111 of the casing 110 is heated, a volume ratio thereof may increase to suppress a suction volume from being reduced.

Furthermore, as illustrated in the exemplar embodiment shown in FIGS. 6 and 8, a first differential pressure hole 161*e* passing through the outer circumferential surface of the back pressure plate 161 may be formed in the middle of the connection passage groove 161*c*, and a fourth connection pipe 183*d* (described in more detail below) may be connected to an outer end of the first differential pressure hole 161*e*. However, the first differential pressure hole 161*e* may be directly connected to either one of the both first differential pressure spaces 161*b*, and the other first differential pressure space 161*b* may be communicated through the connection passage groove 161*c*.

On the other hand, as illustrated in FIGS. 6 and 8, a second valve space 161*g*, which is recessed by a predetermined depth in an axial direction, may be formed on a lower surface of the back pressure plate 161. A plurality of second valve spaces 161*g* may be provided in the nearby vicinity of any one of the plurality of first valve spaces 161*a*.

A back pressure valve 158 for selectively opening and closing between the scroll side back pressure hole 151*a* and the plate side back pressure hole 161*f* may be slidably inserted into the second valve space 161*g*. The back pressure valve 158 may constitute a second valve. The back pressure valve 158 may be formed as a piston valve constituting a check valve. However, it is understood that the back pressure valve is not limited thereto, so long as it be opened and closed by a differential pressure.

Here, as the back pressure valve 158 is configured with a piston valve. The plate side back pressure hole 161*f* and the scroll side back pressure hole 151*a* are spaced apart by a predetermined distance in a lateral direction so as to provide a space for allowing the back pressure valve 158 to move. Accordingly, a connection groove 161*h* for connecting two bypass holes may be formed radially between a lower end of the plate side back pressure hole 161*f* and an upper end of the scroll side back pressure hole 151*a*.

A second valve space 161*g* may be formed between the scroll side back pressure hole 151*a* and the plate side back pressure hole 161*f*.

In such configuration, the plurality of second valve spaces 161*g* may be formed to communicate with a plurality of compression chambers having different pressures for the respective compression chambers constituting the inner and outer pockets, respectively. Thus, when the back pressure valve 158 inserted into each of the plurality of second valve spaces 161*g* is selectively opened and closed in accordance with the operation mode of the compressor, the back pressure chamber 160*a* pressure may be controlled in accordance with the operation mode of the compressor.

For example, as illustrated in the exemplar embodiment shown in FIGS. 7 and 8, during a power operation, the second valve space (hereinafter, referred to as a "low pressure second valve space") 161*g*1 formed in the compression chamber having a relatively low pressure may communicate with the back pressure chamber 160*a*, thereby reducing a pressure of the back pressure chamber 160*a* as compared to the power saving operation.

On the contrary, during a power saving operation, the second valve space (hereinafter, referred to as a "high pressure side second valve space") 161*g*2 communicating with the compression chamber having a relatively high pressure may communicate with the back pressure chamber

160*a*, thereby increasing a pressure of the back pressure chamber as compared to the power operation.

A plurality of second valve spaces 161*g*1, 161*g*2 may be formed in such a manner that second differential pressure spaces 161*j*1, 161*j*2 are sequentially formed on a rear surface thereof, e.g., on a rear pressure side of the back pressure valve 158, and each of the second differential pressure spaces 161*j*1, 161*j*2 may be formed to communicate with second differential pressure holes 161*k*1, 161*k*2 for supplying a suction pressure or discharge pressure to the second differential pressure space.

In such configuration, the second differential pressure hole 161*k*1 communicating with the second valve space 161*g*1 on a low pressure side among the plurality of second differential pressure holes 161*k*1, 161*k*2 may be passed through an outer circumferential surface of the back pressure plate 161 and connected to a second connection pipe 183*b*, and the other second differential pressure hole 161*k*2 may communicate with the center of the connection passage groove 161*c* for communicating a plurality of first differential pressure holes 161*b* with each other. Thus, either one of the plurality of second pressure differential holes 161*k*1, 161*k*2 may be supplied with refrigerant at a suction pressure or discharge pressure through a third valve 180 (described in more detail below) while the other one thereof is introduced with a portion of refrigerant at a suction pressure or discharge pressure supplied to the first differential pressure space 161*b* through the connection passage groove 161*c*.

Furthermore, one end of the back pressure plate 161 may communicate with the intermediate discharge port 167, and the other end thereof may be formed with a discharge pressure hole 168 passing through an outer circumferential surface of the back pressure plate 161, and the discharge pressure hole 168 may be connected to the third valve 180 through the first connection pipe 183*a*. Thus, depending on the operation mode of the compressor, the discharge pressure hole may be selectively communicated with the low pressure side second valve space or the high pressure side second valve space.

On the other hand, the first differential pressure hole 161*e* and the second differential pressure hole may be connected to a control valve 180 constituting the third valve through the second connection pipe 183*b* and the fourth connection pipe 183*d*, respectively. The control valve 180 may be configured with a solenoid valve for switching the operation mode of the compressor between a power operation mode and a power saving operation mode while moving between the first position and the second position depending on whether power is applied thereto or not. The control valve 180 may be provided in the suction space 111 of the casing 110. Alternatively, the control valve 180 may be provided at an outside of the casing 110. Thus, there is design freedom for the control valve 180 as compared to a traditional design. The present embodiment describes an configuration in which the control valve is provided at an outside of the casing.

Here, as illustrated in FIG. 5, the control valve 180 may be attached (e.g., fixed and coupled) to an outer circumferential surface of the casing 110. Such attachment may be done using a bracket 180*a* or other support device. However, the control valve 180 may instead be directly welded to the casing 110 without using a separate bracket or support device.

Furthermore, as illustrated in the embodiment shown in exemplary FIGS. 5 and 8, the control valve 180 may include a power supply unit 181 connected to an external power source to selectively operate the mover 181*b* depending on whether power is applied thereto or not.

The power supply unit 181 may include a mover 181*b* inside a coil 181*a* to which power is supplied, and a return spring 181*c* at one end of the mover. A switching valve 186 may be coupled to the mover 181*b*, the switching valve 186 functioning for connecting between (a first input/output port 185*a* and a second input/output port 185*b*) and (a third input/output port 185*c* and a fourth input/output port 185*d*), or for connecting between (the first input/output 185*a* and the fourth input/output port 185*d*) and (the second input/output port 185*b* and the third input/output port 185*c*). Thus, when power is supplied to the coil 181*a*, the mover 181*b* and the valve 186 coupled to the mover 181*b* move to the first position (power operation mode) to connect the corresponding connection pipes (183*a*, 183*b*) (183*c*, 183*d*) or (183*a*, 183*d*) and (183*b*, 183*c*) to each other, and on the other hand, when power is turned off, the mover 181*b* connects the other connection pipes to each other while returning to the second position (power saving operation mode) by the return spring 181*c*. As a result, refrigerant directed to the bypass valve 155, which is a check valve, and the back pressure valve 158, is switched in accordance with the operation mode of the compressor.

On the other hand, a valve portion 182 for switching a flow direction of refrigerant while being operated by the power supply unit 181 may be coupled to one side of the power supply unit 181.

The valve portion 182 may be configured such that the switching valve 186 extending to the mover 181*b* of the power supply unit 181 is slidably inserted into a valve housing 185 coupled to the power supply unit 181. Depending on the configuration of the power supply unit 181, the switching valve 186 may change the flow direction of refrigerant while rotating without performing a reciprocating motion. However, in the present embodiment, for purposes of convenience, a linear reciprocating valve is described.

The valve housing 185 may be formed with an elongated cylindrical shape, and four input/output ports may be formed along a longitudinal direction. The first input/output port 185*a* may be connected to the discharge pressure hole 168 through the first connection pipe 183*a*. The second input/output port 185*b* may be connected to the second differential pressure hole 161*j*1 at a lower pressure side through the second connection pipe 183*b*. The third input/output port 185*c* may be connected to the suction space 111 of the casing 110 through the third connection pipe 183*c*. The fourth input/output port 185*c* may be connected to the first differential pressure hole 161*e* through the fourth connection pipe 183*d*. Such connections are described in more detail below.

On the other hand, the valve portion 182 may be coupled to a connection portion 183 coupled through the casing 110 in order to transfer the refrigerant switched by the valve portion 182 to the first differential pressure space 161*b* and the second differential pressure space 161*j*.

The connection portion 183 may include a first connection pipe 183*a*, a second connection pipe 183*b*, a third connection pipe 183*c*, and a fourth connection pipe 183*d* to selectively inject refrigerant at a discharge pressure or suction pressure into the bypass valve 155 constituting the first valve and the back pressure valve 158 constituting the second valve.

The first connection pipe 183*a*, the second connection pipe 183*b*, the third connection pipe 183*c*, and the fourth connection pipe 183*d* may each be welded and/or coupled to the casing 110. Each connection pipe may be formed of the same material as that of the casing 110, or be formed of a different material from that of the casing 110. As illustrated in FIG. 5, when the material of the connection pipe is different from that of the casing 110, an intermediate member 184 may be used in consideration of welding directly to the casing.

On the other hand, although not shown in the drawings, the valve space, the differential pressure space, the exhaust groove, and the connection passage groove may be formed on an upper surface of the non-orbiting scroll as opposed to a lower surface of the back pressure plate 161.

In the drawing, reference numerals, 119, 155*a*, 155*b*, 156, 157, 159 and 169 denote a terminal 119, an opening and closing surface 155*a*, a back pressure surface 155*b*, a bypass valve for opening and closing a discharge bypass hole through which part of refrigerant compressed in the intermediate pressure chamber is bypassed to prevent overcompression 156, an O-ring 157, a check valve for blocking refrigerant discharged to the discharge space from flowing back to the compression chamber 159, and a connection pipe fixing pin 169.

A process of varying the capacity of the compressor in a scroll compressor according to an embodiment of the present disclosure is described below.

Figure 10A:
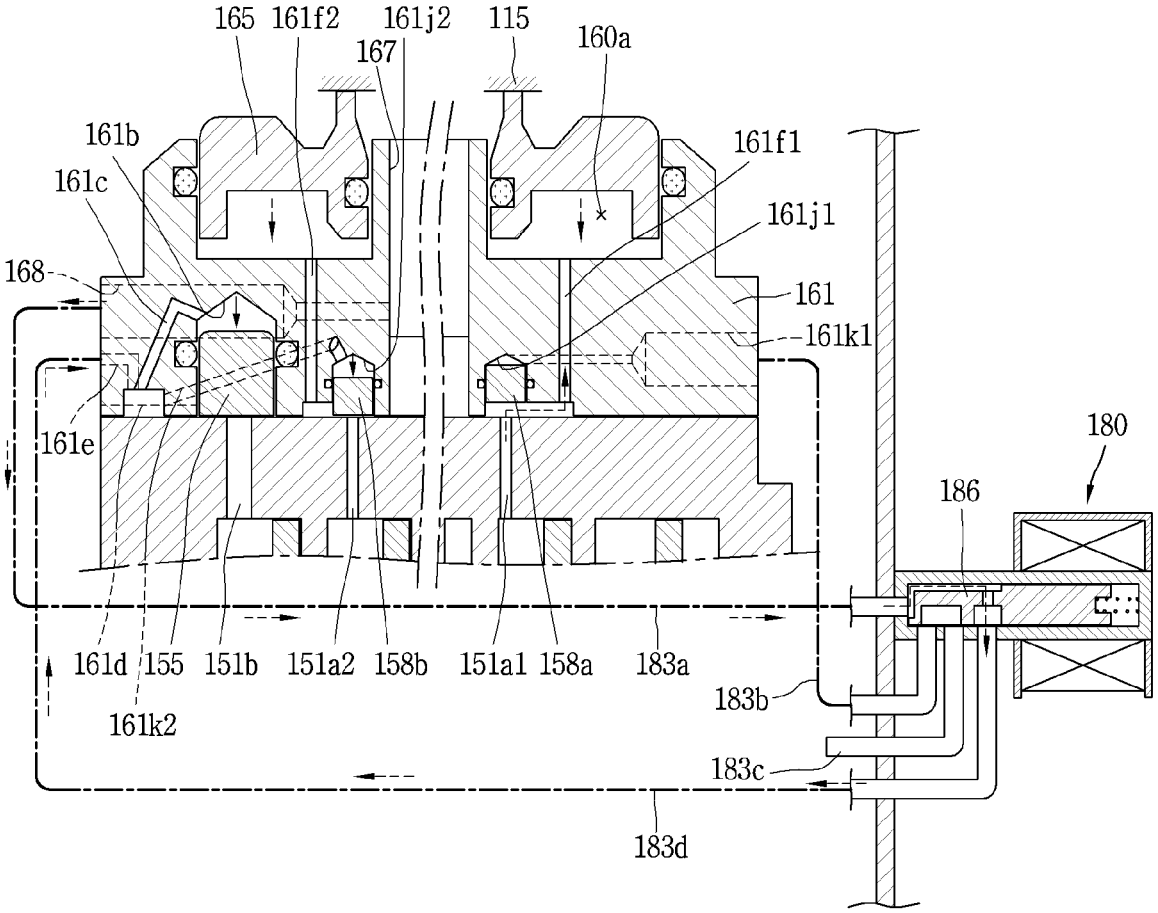
FIG. 10A is a schematic view illustrating the operation of a first valve and a second valve according to a power mode operation mode of the compressor in FIG. 8.

As illustrated in the embodiment shown in exemplary FIG. 10A, when the compressor performs a power operation, refrigerant at a discharge pressure discharged through the intermediate discharge port 167 may flow into the first differential hole 161*e* through the discharge pressure hole 168, the first connection pipe 183*a*, and the fourth connection pipe 183*d* by the control valve 180; and the refrigerant at a discharge pressure flowing into the first differential pressure hole 161*e* may be supplied to both the first differential pressure spaces 161*b* through the connection passage groove 161*c*.

Then, a pressure of the first differential pressure space 161*b* may pressurize the back pressure surface 155*b* of the bypass valve 155 while forming a discharge pressure. At this time, as a cross-sectional area of the first pressure differential space 161*b* is larger than that of the bypass hole 151*b* but also the pressure of the first differential pressure space is greater than that of the compression chamber applied to the opening and closing surface 155*a* of the bypass valve 155, both the bypass valves 155 are pushed by the pressure of the first differential pressure space 161*b* to block the respective bypass holes 151*b*.

Here, refrigerant at a discharge pressure may also flow into a high pressure side second pressure space 161*j*2 connected to the center of the connection passage groove 161*c*, thereby blocking a high pressure side back pressure valve (hereinafter, a "second back pressure valve") while pressurizing a high pressure side back pressure valve (hereinafter, a "back pressure valve") 158*b*.

At the same time, refrigerant at a suction pressure filled in the suction space 111 of the casing 110 may be supplied to a low pressure side second differential pressure space 161*j*1 through the third connection pipe 183*c* and the second connection pipe 183*b*.

Then, for a low pressure side back pressure valve (hereinafter, a "first back pressure valve") 158*a* provided in a low pressure side second valve space 161*g*1, a low pressure side second differential pressure space 161*j*1 may form a suction pressure that is lower than the pressure of the compression chamber, and as a result, the first back pressure valve 158*a* may move in an opening direction to open between low pressure side back pressure holes (hereinafter, first back pressure holes) 151*a*1, 161*f*1.

Then, the refrigerant of the compression chamber having a relatively lower intermediate pressure than the compression chamber connected to the second back pressure holes 151*a*2, 161*f*2 may be supplied to the back pressure chamber 160*a* through the scroll side back pressure hole 151*a*1, the connection groove 161*h*1, and the plate side back pressure hole 161*f*1 (the scroll side back pressure hole 151*a*1 and the plate side back pressure hole 161*f*1 together constitute "first back pressure holes 151*a*1, 161*f*1").

Then, even when the compressor performs a full load operation, e.g., a power operation, a back pressure of the back pressure chamber may not be high, thereby suppressing contact, or excessively close contact, between the first scroll and the second scroll. Through this, a reduction of friction loss is possible during power operation, thereby improving the efficiency of the compressor.

Figure 10B:
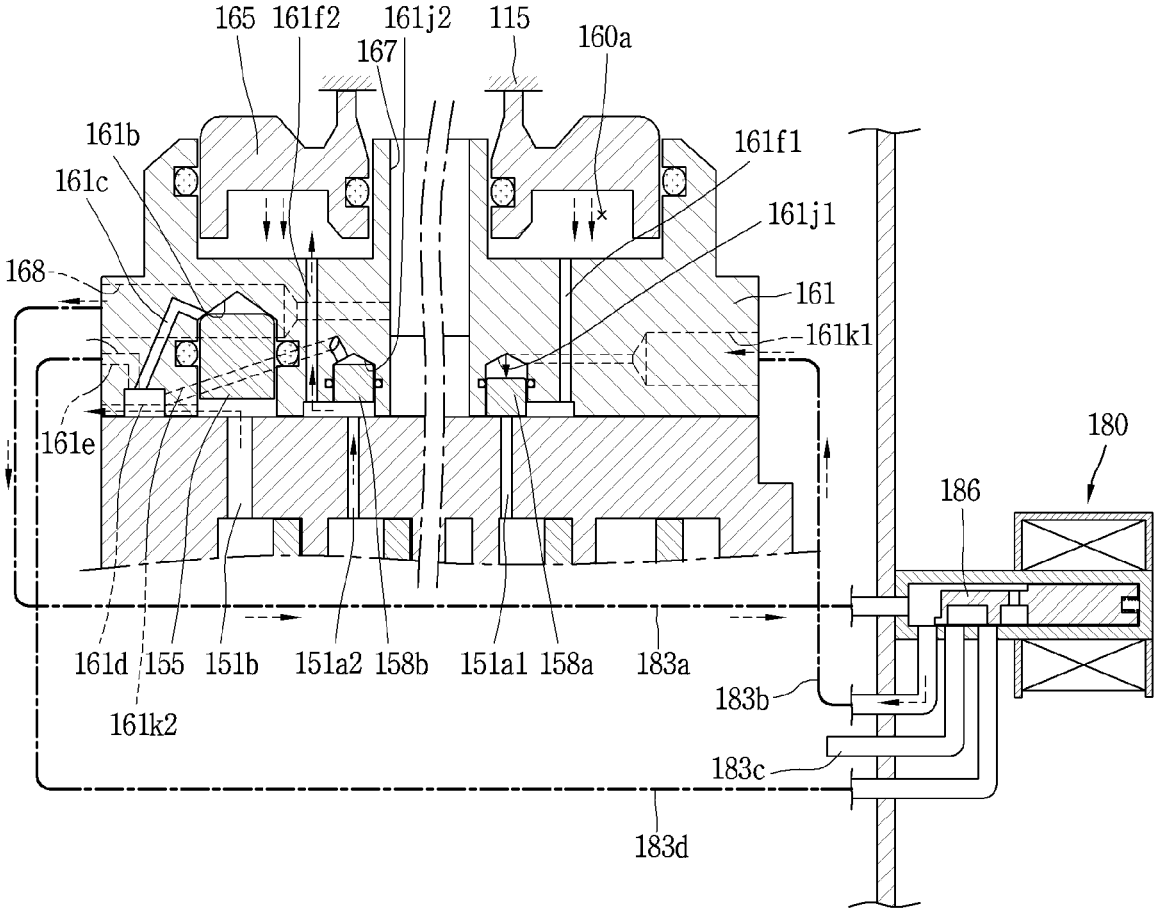
FIG. 10B is a schematic view illustrating the operation of a first valve and a second valve according to a power saving mode operation mode of the compressor in FIG. 8.

To the contrary, such as illustrated in FIG. 10B, when the compressor performs a power saving operation, refrigerant at a discharge pressure discharged to the discharge space 112 through the intermediate discharge port 167 by the control valve 180 may be supplied to the low pressure side differential pressure space 161*j*1 through the first connection pipe 183*a* and the second connection pipe 183*b*.

Then, for the first back pressure valve 158*a* provided in the low pressure side second valve space 161*g*1, the low pressure side second differential pressure space 161*j*1 may form a discharge pressure that is greater than the pressure of the compression chamber, and as a result, the first back pressure valve 158*a* may move in a closing direction to close between the first back pressure holes 151*a*1, 161*f*1.

At the same time, refrigerant at a suction pressure filled in the suction space 111 of the casing 110 may flow into the first differential pressure hole 161*e* through the third connection pipe 183*c* and the fourth connection pipe 183*d*; and the refrigerant at a suction pressure flowing into the first differential pressure hole 161*e* may be supplied to both the first differential pressure spaces 161*b* through the connection passage groove 161*c*.

Then, a pressure in the first differential pressure space 161*b* may form a suction pressure, and the bypass valve 155 may be pushed by the pressure of the compression chamber forming an intermediate pressure to open each bypass hole 151*b*.

Then, as refrigerant flows into the suction space 111 of the casing 110 through the respective exhaust grooves 161*d* in the respective intermediate compression chambers while opening the second bypass holes 151*b*, the compressor performs a power saving operation.

Here, refrigerant at a suction pressure may also flows into the high pressure side second differential pressure space 161*j*2 connected to the center of the connection passage groove 161*c*, and as a result, the second back pressure valve 158*b* may move in an opening direction to open between the second back pressure hole 151*a*2, 161*f*2.

Then, the refrigerant of the compression chamber having a relatively higher intermediate pressure than the compression chamber connected to the first back pressure holes 151*a*1, 161*f*1 may be supplied to the back pressure chamber 160*a* through the scroll side back pressure hole 151*a*2, the connection groove 161*h*2, and the plate side back pressure hole 161*f*2.

Then, when the compressor performs a partial load operation, e.g., a power saving operation, the compressor may have a high back pressure of the back pressure chamber, thereby allowing the first scroll and the second scroll to be brought into close contact with each other. Consequently, refrigerant leakage that may occur during power saving operation may be prevented or substantially minimized, thereby improving the efficiency of the compressor.

As a result, a scroll compressor according to an exemplary embodiment of the invention may have a plurality of back pressure holes communicating with a back pressure chamber that are formed at predetermined intervals to control a pressure of the back pressure chamber according to a capacity variation of the compressor so as to prevent a reduction in efficiency due to capacity variation as well as significantly reduce a capacity variation ratio of the compressor.

Furthermore, a back pressure may be controlled differently according to the operation mode of the compressor in order to prevent refrigerant leakage during a power saving operation while at the same time reducing friction loss during a power operation, thereby increasing compressor efficiency and improving the efficiency of a system to which the compressor is applied.

In addition, an unnecessary input load may be reduced while lowering the capacity variable ratio through a plurality of bypass holes, thereby increasing compressor efficiency and improving the efficiency of a system to which the compressor is applied.

Moreover, a valve for opening and closing a bypass passage of refrigerant may be configured with a bypass valve operated by a small pressure change, thereby enabling the operation mode of the compressor to be quickly and precisely switched between a power operation and a power saving operation.

On the other hand, according to the foregoing exemplary embodiments, although a low pressure scroll compressor has been described, it is understood that the present disclosure may be similarly applied to all hermetic compressors in which an internal space of the casing is divided into a suction space which is a low pressure portion and a high pressure discharge space which is a high pressure portion.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having an inner space;

an first scroll provided inside the casing, the first scroll being an orbiting scroll;

a second scroll provided inside the casing, the second scroll being a non-orbiting scroll;

a compression unit provided in the inner space of the casing, the compression unit having a compression chamber that is formed by the first and second scrolls;

a bypass hole provided in the compression unit and through which refrigerant suctioned into the compression chamber is bypassed to the inner space of the casing;

a bypass valve configured to selectively open and close the bypass hole in order to vary a compression capacity of the compression chamber;

a back pressure chamber provided at a rear side of one of the first and second scrolls to support that scroll toward the direction of the other of the first and second scrolls;

a back pressure passage configured to communicate between the compression chamber and the back pressure chamber; and a back pressure valve configured to selectively open and close the back pressure passage, wherein the compression chamber comprises a plurality of compression chambers having different pressures, and wherein the back pressure passage comprises a plurality of back pressure passages, whereby the plurality of back pressure passages are in communication with the compression chambers having different pressures, respectively, and whereby the plurality of back pressure passages open and close in opposite directions to each other according to an operation mode of the compressor.

2. The scroll compressor of claim 1, wherein one side surface of the plurality of back pressure valves is in contact with the compression chamber and is respectively supported by an intermediate pressure between a suction pressure and a discharge pressure, and another side surface thereof opposite to the compression chamber is respectively supported by the suction pressure or discharge pressure.

3. The scroll compressor of claim 1, wherein the bypass hole comprises a plurality of bypass holes, the plurality of bypass holes being configured to independently communicate with the plurality of compression chambers, respectively.

4. The scroll compressor of claim 1, wherein a space provided at one side surface of one of the plurality of back pressure valves is in communication with a space provided at one side surface of the bypass valve.

5. The scroll compressor of claim 4, wherein the plurality of back pressure passages comprise a first back pressure passage and a second back pressure passage, the first back pressure passage being in communication with a first compression chamber having a relatively high pressure from among the plurality of compression chambers, and the second back pressure passage being in communication with a second compression chamber having a relatively low pressure from among the plurality of compression chambers, whereby the first back pressure passage communicates with the back pressure chamber during a power saving operation and the second back pressure passage communicates with the back pressure chamber during a power operation.

6. The scroll compressor of claim 5, further comprising:

a control valve configured to control the opening and closing of both the bypass valve and the back pressure valve, wherein the control valve is provided at outside of the casing.

7. The scroll compressor of claim 1, further comprising:

a control valve configured to control the opening and closing of both the bypass valve and the back pressure valve.

8. A scroll compressor, comprising:

a casing having an inner space;

a drive motor provided in the inner space of the casing;

a first scroll disposed in the inner space of the casing, the first scroll being coupled to a rotation shaft configured to transmit a rotational force of the drive motor to perform an orbiting motion of the first scroll;

a second scroll engaged with the first scroll to form a compression chamber comprised of a suction chamber, an intermediate pressure chamber, and a discharge chamber;

a back pressure chamber assembly provided at a rear surface of the second scroll to form a back pressure chamber that is configured to pressurize the second scroll in a direction toward the first scroll;

a bypass hole provided between the compression chamber and an internal space of the casing, the bypass hole being configured to bypass refrigerant suctioned into the compression chamber to the internal space of the casing;

a back pressure hole provided between the compression chamber and the back pressure chamber, the back pressure hole being configured to guide a portion of refrigerant compressed in the compression chamber to the back pressure chamber;

a first valve provided in the second scroll or the back pressure chamber assembly, the first valve being configured to selectively open and close the back pressure hole;

a second valve provided in either the second scroll or the back pressure chamber assembly, the second valve being configured to selectively open and close the bypass hole; and a third valve provided being configured to operate the first valve and the second valve, wherein the back pressure hole comprises a first back pressure hole and a second back pressure hole, wherein the compression chamber comprises a plurality of compression chambers, and the first back pressure hole is in communication with a first compression chamber of the plurality of compression chambers, and the second back pressure hole is in communication with a second compression chamber from among the plurality of compression chambers, the second compression chamber having a higher pressure than the first compression chamber.

9. The scroll compressor of claim 8, wherein the first back pressure hole communicates with the back pressure chamber when an operation mode of the compressor is a power operation, and the second back pressure hole communicates with the back pressure chamber when the operation mode of the compressor is a power saving operation.

10. The scroll compressor of claim 9, wherein the second back pressure hole communicates with a rear side space of the first valve during the power operation, and the first back pressure hole communicates with a rear side space of the first valve during the power saving operation.

11. The scroll compressor of claim 8, wherein the inner space is comprises a high pressure portion and a low pressure portion, and a low pressure portion of the casing is communicated with the first back pressure hole and a rear side space of the first valve while a high pressure portion of the casing is communicated with the second back pressure hole and the back pressure chamber when an operation mode of the compressor is a power operation, and a low pressure portion of the casing is communicated with the second back pressure hole and the back pressure chamber while a high pressure portion of the casing is communicated with the first back pressure hole and a rear side space of the second valve when the operation mode of the compressor is a power saving operation.

12. The scroll compressor of claim 8, wherein the bypass hole comprises a plurality of the bypass holes, the plurality of bypass holes being opened and closed by a plurality of first valves independently provided, the plurality of first valves are independently accommodated in respective valve spaces, and each of the valve spaces is respectively communicated with a connection passage, the connection passage being connected to one of the plurality of back pressure holes through the relevant back pressure valve, and another one of the plurality of back pressure holes being connected to a portion of the connection passage communicating with the suction chamber or a portion of the connection passage communicating with the discharge chamber by interposing the relevant back pressure valve therebetween in accordance with an operation mode of the compressor.

* * * * *